US007159564B2

(12) United States Patent
Yanagii

(10) Patent No.: US 7,159,564 B2
(45) Date of Patent: Jan. 9, 2007

(54) LINK TYPE THROTTLE VALVE CONTROL DEVICE IN THROTTLE BODY

(75) Inventor: Yoichi Yanagii, Kawasaki (JP)

(73) Assignee: Keihin Corporation, Shinjuku-ku (JP)

( * ) Notice: Subject to any disclaimer, the term of this patent is extended or adjusted under 35 U.S.C. 154(b) by 0 days.

(21) Appl. No.: 11/377,247

(22) Filed: Mar. 17, 2006

(65) Prior Publication Data

US 2006/0207553 A1 Sep. 21, 2006

(30) Foreign Application Priority Data

Mar. 17, 2005 (JP) ..... 2005-077003

(51) Int. Cl.
*F02D 11/02* (2006.01)
*F02D 11/04* (2006.01)

(52) U.S. Cl. ..... 123/400; 123/337; 123/342

(58) Field of Classification Search ..... 123/400, 123/337, 342
See application file for complete search history.

(56) References Cited

U.S. PATENT DOCUMENTS 5,033,433 A * 7/1991 Churchill et al. ..... 123/361
5,738,069 A * 4/1998 St. Pierre et al. ..... 123/342
6,886,529 B1 * 5/2005 Suzuki et al. ..... 123/400
2006/0005808 A1 * 1/2006 Blomenberg et al. ..... 123/399
2006/0162694 A1 * 7/2006 Sakaguchi et al. ..... 123/400
2006/0185645 A1 * 8/2006 Spickermann et al. ..... 123/400

* cited by examiner

*Primary Examiner*—Erick Solis
(74) *Attorney, Agent, or Firm*—Bacon & Thomas PLLC

(57) ABSTRACT

To easily carry out change pulling directions of opening and closing wires in a link type throttle valve control device, a throttle valve operation dram 61 and a first link lever 62 are mounted at a throttle valve operation shaft 3, the throttle valve operation dram 61 has opening and closing valve end inserting holes 61*a*, 61*b*, the throttle valve operation shaft 3 is rotatably provided at a stay plate 1 having first and second cable guide inserting holes 1*d*, 1*e*, and rotatably provided coaxially with a throttle valve shaft 52, first and second link levers 62, 56 mounted at the throttle valve shaft 52 are linked by a connection lever 63*a*, the stay plate 1 is rotated to a desired position around the throttle valve shaft 52, and in this state, the stay plate 1 is fixed at a throttle body 50 by screws 5.

4 Claims, 7 Drawing Sheets

(PRIOR ART)

(PRIOR ART)

LINK TYPE THROTTLE VALVE CONTROL DEVICE IN THROTTLE BODY

BACKGROUND OF THE INVENTION

1. Field of the Invention

The present invention relates to a fuel injection device, in which fuel in a fuel tank is increased in pressure by a fuel pump, and the fuel increased in pressure is injected toward an engine through a fuel injection valve. More particularly, the present invention relates to a link type throttle valve control device for opening/closing a throttle valve of the throttle body through a link mechanism, where the throttle valve controls air content toward the engine. The link type throttle valve control device is used when opening characteristics with respect to a pulling margin of an accelerator wire is changed.

2. Description of the Conventional Art

A conventional link type throttle valve control device in a throttle body is illustrated in FIGS. 6 and 7.

FIG. 6 is a side view of a link type throttle valve control device, and FIG. 7 is a longitudinal sectional view taken along a line C—C in FIG. 6.

Reference numeral 50 is a throttle body in which an intake passage 51 is provided through inside thereof, and a throttle valve shaft 52 is supported rotatably to a throttle body 50 while crossing the intake passage 51.

A butterfly shaped throttle valve 53 is mounted at a throttle valve shaft 52 by a screw 54, and the throttle valve shaft 52 is rotated in one or reverse direction, to thereby open/close the intake passage 51 by the throttle valve 53.

In FIG. 7, a right end of the throttle valve shaft 52 is projected toward the right side further from an end portion of a right side bearing boss 50*a*. A return lever 55 and a second link lever 56 are fixedly mounted at the right end of the throttle valve shaft More particularly, a D shaped cutout portion 52*a* is formed at the right end of the throttle valve shaft 52, and D cut holes 55*a*, 56*a* are provided at the return lever 55 and the second link lever 56, where these holes are fitted to the cutout portion 52*a*. The D cut hole 55*a* of the return lever 55 is fitted to the cutout portion 52*a* of the throttle valve shaft 52, and the D cut hole 56*a* of the second link lever 56 is fitted to the cutout portion 52*a* of the throttle valve shaft 52. In this state, the return lever 55 and the second link lever 56 are screwed and fixed at the right end of the throttle valve shaft 52 by a screw nut 58 through a collar 57.

That is, the return lever 55 and the second link lever 56 are simultaneously rotated.

Reference numeral 59 is first return spring, where one end is locked with the throttle body 50 and another end is locked with the return lever 55. The first return spring 59 gives rotating force to the return lever 55 in the clockwise direction in FIG. 6. (This rotating force is energizing force in the closing direction to the throttle valve 53, and the throttle valve 53 opens the intake passage 51 when rotating in the counterclockwise in FIG. 6.)

Further, an operation bearing boss 50*c* extending toward the right side is integrally formed at an upper portion of a wall portion 50*b*, which extends upwardly from the throttle body 50. A throttle valve operation shaft 60 is supported rotatably in an operation bearing hole 50*d* provided at the operation bearing boss 50*c*.

A right end of the throttle valve operation shaft 60 is projected toward right further from a right end of 50*ca* of the operation bearing boss 50*c*, and the projected portion is mounted fixedly with a throttle valve operation dram 61 and a first link lever 62 by a nut 63. Therefore, the throttle valve operation dram 61 and the first link lever 62 are simultaneously rotated.

Mounting method for the throttle valve operation dram 61 and the first link lever 62 to the throttle valve operation shaft 60 is carried out like the return lever 55 and the second link lever 56.

A valve opening end inserting hole 61*a* and a valve closing end inserting hole 61*b* are provided at the throttle valve operation dram.

Further, the first link lever 62 and the second link lever 56 are connected with a connection lever 63*a* so as to move to interlock each other. A link mechanism R is formed with the first link lever 62, the second link lever 56 and the connection lever 63*a*.

Further, reference numeral 64 is a stay plate formed by bending a metal plate. The stay plate 64 is screwed and fixed at a boss portion 50*g* of the throttle body 50 being near the operation bearing boss 50*c* by a screw 69.

A first cable guide inserting hole 64*a* and a second cable guide inserting hole 64*b* are formed on the stay plate 64, where the hole 64*a* faces to the valve opening end inserting hole 61*a*, and the hole 64*b* faces to the valve closing end inserting hole 61. Further, an accelerator grip, which is not illustrated in the drawings, and the throttle valve operation dram 61 are connected as follows.

Reference numeral 65 is a first cable guide, which is inserted and provided in the first cable guide inserting hole 64*a* and held by the stay plate 64 with nuts 66*a*, 66*b*. A valve opening wire end Wa1 is provided at one end of the opening valve wire Wa inserted and provided in the first cable guide 65, and inserted and locked in the closing valve end inserting hole 61*a* of the throttle valve operation dram 61, and another end is locked with the accelerator grip which is not illustrated in the drawings.

Reference numeral 67 is a second cable guide, which is inserted and provided in the second cable guide inserting hole 64*b* and held by the stay plate 64 with nuts 68*a*, 68*b*. A valve closing wire end Wb1 is provided at one end of the closing valve wire Wb inserted and provided in the second cable guide 67, and inserted and locked in the closing valve end inserting hole 61*b* of the throttle valve operation dram 61, and another end is locked with the accelerator grip which is not illustrated in the drawings.

Reference numeral 69 is a return spring, in which one end is locked with the stay plate 64 and another end is locked with the throttle valve operation dram 61. The throttle valve operation dram 61 is energized in the counterclockwise direction in FIG. 6 by the second return spring 69.

SUMMARY OF THE INVENTION

According to such the conventional link type throttle valve control device, when the accelerator grip which is not illustrated in the drawings is rotated in the one direction to thereby pull the opening valve wire end Wa in the right direction in FIG. 6, movement of the opening valve wire Wa is transmitted to the opening valve end inserting hole 61*a* from the opening valve wire end Wa1 and thereby the throttle valve operation dram 61 and the first link lever 62 are simultaneously rotated in the clockwise direction in FIG. 6 against the spring force of the second return spring 69.

Further, rotation of the first link lever 62 in the clockwise direction is transmitted to the second link lever 56 through the connection lever 63*a* and thereby the second link lever 56 and the return lever 55 are simultaneously rotated in the counterclockwise direction in FIG. 6 against the spring force of the first return spring 59. Accordingly, the throttle valve 53 opens the intake passage 51 according to movement of the opening vale wire Wa.

In the above description, the closing valve wire Wb is pulled in the left direction in FIG. 6, by following the rotation of the throttle valve operation dram 61 in the clockwise direction.

On the other hand, when the accelerator grip is rotated in another direction to thereby pull the closing valve wire Wb in the right direction in FIG. 6, movement of the closing valve wire Wb is transmitted to the closing valve end inserting hole 61*b* from the closing wire end Wb1, to thereby simultaneously rotate the throttle valve operation dram 61 and the first link lever 62 in the counterclockwise direction in FIG. 6. (The second return spring 69 supports the rotation in the counterclockwise direction.)

Further, rotation of the first link lever 62 in the counterclockwise direction is transmitted to the second link lever 56 through the connection lever 63*a* and thereby, the second link lever 56 and the return lever 55 are simultaneously rotated in the clockwise direction in FIG. 6. Accordingly, the throttle valve 53 closes the intake passage 51 according to movement of the closing valve wire Wb.

In such the conventional link type throttle valve control device, when the pulling directions X of the opening valve wire Wa and the closing valve wire Wb are desired to be changed, it is hard to do those. (This change becomes necessary when arrangement of the throttle body and the accelerator grip and routing of the wire or the like are different with vehicles especially in the motorcycle.)

That is, a relative position relationship between the first cable guide inserting hole 64*a* of the stay plate 64 and the opening valve end inserting hole 61*a* of the throttle valve operation dram 61, and a relative position relationship between the second cable guide inserting hole 64*b* and the closing valve end inserting hole 61*b* are required to be held in fixed positions. Further, when positions of the first and second cable guide inserting holes 64*a*, 64*b* of the stay plate 64 are changed in order to change the pulling direction of the wire, it is necessary to simultaneously change the positions of the opening valve and closing valves end inserting holes 61*a*, 61*b* of the throttle valve operation dram 61.

Therefore, it is necessary to newly manufacture two structural parts of the stay plate 64 and the throttle valve operation dram 61. These parts are manufactured by pressing molds, so that the costs of these parts are remarkably increased.

Further, management is necessary to be made about the stay plates 64 and the throttle valve operation drams 61, which have a plurality of shapes respectively, so that management cost is also increased.

Furthermore, since the operation bearing boss 50*c* supporting the throttle valve operation shaft 60 is integrally formed with the throttle body 50, the throttle body 50 is made large in size and a mold structure becomes to be complicated. Thus, the moldablity of the throttle body 50 is decreased by increasing of the mold cost of the throttle body 50 and the size of the throttle body 50.

The present invention solves the above-described problems, and an objective of the present invention is to provide a link type throttle valve control device in a throttle body, in which the pulling directions of the opening valve and closing valve wires are changed by remarkably easy method with a low cost, and a throttle body itself is made compact.

In order to achieve the above-described objective, a link type throttle valve control device in a throttle body according to a first aspect of the present invention comprises;

a throttle valve shaft crossing an intake passage provided in the throttle body, mounting a throttle valve for opening/closing the intake passage, and being supported rotatably to by the throttle body;

a throttle valve operation shaft being supported rotatably to the throttle body, and mounting a throttle body operation dram provided with an opening valve end inserting hole and a closing valve end inserting hole at an end portion thereof;

a stay plate provided with a first cable guide inserting hole and a second cable guide inserting hole, and mounted at the throttle body; and a link mechanism comprising a first link lever mounted at an end portion of the throttle valve operation shaft, a second link lever mounted at an end portion of the throttle valve shaft, and a connection lever for connecting the first link lever and the second link lever.

In this device, rotation of the throttle valve operation dram operated by an operator is transmitted to the throttle valve shaft through the link mechanism, to thereby open/close the intake passage by throttle valve. Further, the throttle valve operation shaft is rotatably provided at the stay plate, where the throttle valve operation dram and the first link lever are mounted on the throttle valve operation shaft, and the opening valve end inserting hole and the closing valve end inserting hole are provided in the throttle valve operation dram. Further, the first cable guide inserting hole and the second cable guide inserting hole are formed on the stay plate. Further, the stay plate is rotatably provided coaxially with a longitudinal axial line of the throttle valve shaft, and the first link lever and the second link lever mounted at the throttle valve shaft are linked by a connection lever. Furthermore, the stay plate is rotated to be provided at a position being desired with respect to the throttle valve shaft, and screwed and fixed at the throttle body with screws to keep this state.

A link type throttle valve control device in a throttle body according to a second aspect of the present invention comprises;

a throttle valve shaft crossing an intake passage provided at the throttle body, mounting a throttle valve for opening/closing the intake passage, and being supported rotatably to the throttle body;

a throttle valve operation shaft being supported rotatably to the throttle body, and mounting a throttle body operation dram provided with an opening valve end inserting hole and a closing valve end inserting hole at an end portion thereof;

a stay plate provided with a first cable guide inserting hole and a second cable guide inserting hole, and mounted at the throttle body; and a link mechanism comprising a first link lever mounted at an end portion of the throttle valve operation shaft, a second link lever mounted at an end portion of the throttle valve shaft, and a connection lever for connecting the first link lever and the second link lever.

In this device, rotation of the throttle valve operation dram operated by an operator is transmitted to the throttle valve shaft through the link mechanism, to thereby open/close the intake passage by throttle valve. Further, a throttle operation chamber is formed in a sealing state by a first case body in a bottomed cup shape and a second case body for closing an opening of the first case body, where the first case body comprises a bottom portion contacted with the throttle body and a wall portion extending in the one side direction from the bottom portion. The bottom portion of the first case body is rotatably provided coaxially with a longitudinal axial line of the throttle valve shaft. Further, the throttle valve operation shaft is supported rotatably to the first case body, where the throttle valve operation dram and the first link lever are mounted on the throttle valve operation shaft, and the throttle valve operation dram is provided with the opening valve end inserting hole and the closing valve end inserting hole. Further, the first cable guide inserting hole and the second cable guide inserting hole are formed on the wall portion of the first case body. The throttle valve operation dram, the first link lever, the second link lever and the connection lever, which is for connecting the first link lever and the second link lever, are provided in the throttle operation chamber. Further, the first case body is rotated to be provided at a position being desired with respect to the throttle valve shaft. The bottom portion of the first case body is screwed and fixed at the throttle body by screws to keep this state.

A link type throttle valve control device in a throttle body according to a third aspect of the present invention is structured such that, in addition to the first and second aspects, circular-arc groove are provided in the radial direction at the bottom portion of the stay plate or the first case body on the basis of the longitudinal axial line of the throttle valve shaft, and the stay plate or the first case body is screwed and fixed at the throttle body by the screws through the circular-arc grooves.

According to the first aspect, the throttle valve operation shaft is rotatably provided at the stay plate, and the throttle valve operation dram and the first link lever are mounted at an end portion of the throttle valve operation shaft, where the throttle valve operation dram is provided with the opening valve end inserting hole and the closing valve end inserting hole. Further, the first cable guide inserting hole facing to the opening valve end inserting hole and the second cable guide inserting hole facing to the closing valve end inserting hole are formed at the stay plate.

Furthermore, the stay plate is rotatably provided coaxially with respect to the longitudinal axial line of the throttle valve shaft.

Therefore, when pulling directions of an opening valve wire and a closing valve wire are changed, the stay plate is rotated to a desired fixing position on the basis of the longitudinal axial line of the throttle valve shaft. While this state is kept, the stay plate is screwed and fixed at the throttle body by the screws.

Accordingly, the opening valve end inserting hole, the closing valve end inserting hole, the first cable guide inserting hole and the second cable guide inserting hole, which are provided at the throttle valve operation dram, are arranged at the common stay plate and rotated. Thus, the pulling direction of the wire can be freely changed while the relative position relationships between the opening valve end inserting hole and the first cable guide inserting hole, and between the closing valve end inserting hole and the second cable guide inserting hole are kept in the original positional relation.

Further, the link mechanism comprising the first link lever, the connection lever and the second link lever is rotated on the basis of the longitudinal axial line of the throttle valve shaft, so that the link connection as in the original state can be kept.

Therefore, the pulling directions of the opening valve and the closing valve wires can be changed without changing the stay plate, the operation dram, the link mechanism and the throttle body, so that the throttle body suitable for the motorcycle especially can be provided.

Further, according to the above-described structure, it is not necessary to prepare a plurality of shapes of stay plates, operation drams and link mechanism. Thus, it can be prevented to increase the cost of parts according to the change of the press mold or the like, and increase a management process of parts according to increasing of kinds of parts.

Especially, since the throttle valve operation shaft is supported rotatably to the stay plate, it is not necessary to provide the operation bearing boss at the throttle body. Thereby, the throttle body can be decreased in size, and manufacturing ability by an injection molding of the throttle body can be remarkably enhanced.

Further, according to the second aspect, the throttle valve operation shaft is rotatably provided at the first case body, and the throttle valve operation dram and a first return lever are mounted at the end portion of the throttle valve operation shaft, where the opening valve end inserting hole and the closing valve end inserting hole are provided in the throttle valve operation dram. Further, the first cable guide inserting hole facing to the opening valve end inserting hole and the second cable guide inserting hole facing to the closing valve end inserting hole are formed at the first case body.

Further, the first case body is rotatably provided coaxially with respect to the longitudinal axial line of the throttle valve shaft.

Furthermore, the opening of the first case body is closed by the second case body, so that the throttle operation chamber is formed.

According to such the second aspect, in addition to the first aspect, the link mechanism comprising the return lever including a first return spring provided at the end portion of the throttle valve shaft, the throttle valve operation dram including a second return spring, the first link lever, the connection lever and the second link lever, is provided in the throttle operation chamber formed in the sealing state by the first case body and the second case body. Thus, in a vehicle used on off-road, such as a motocrosser or the like, the above-described structure can be surely protected from mud, water and dust.

Further, according to the third aspect of the present invention, the circular-arc grooves are provided in the radial direction at the bottom portion of the stay plate or the first case body on the basis of the center of rotation of the stay plate or the first case body with respect to the throttle valve shaft. Thus, the stay plate or the first case body can be rotated to the desired position by loosing the screws provided in the circular-arc grooves. Then, the screws are screwed to the throttle body through the circular-arc grooves. Thereby, the stay plate or the first case body can be provided at the desired position.

DETAILED DESCRIPTION OF PREFERRED EMBODIMENT

Hereinafter, one example of the link type throttle valve control device in the throttle body according to the present invention will be described with FIGS. 1 and 2.

Figure 1:
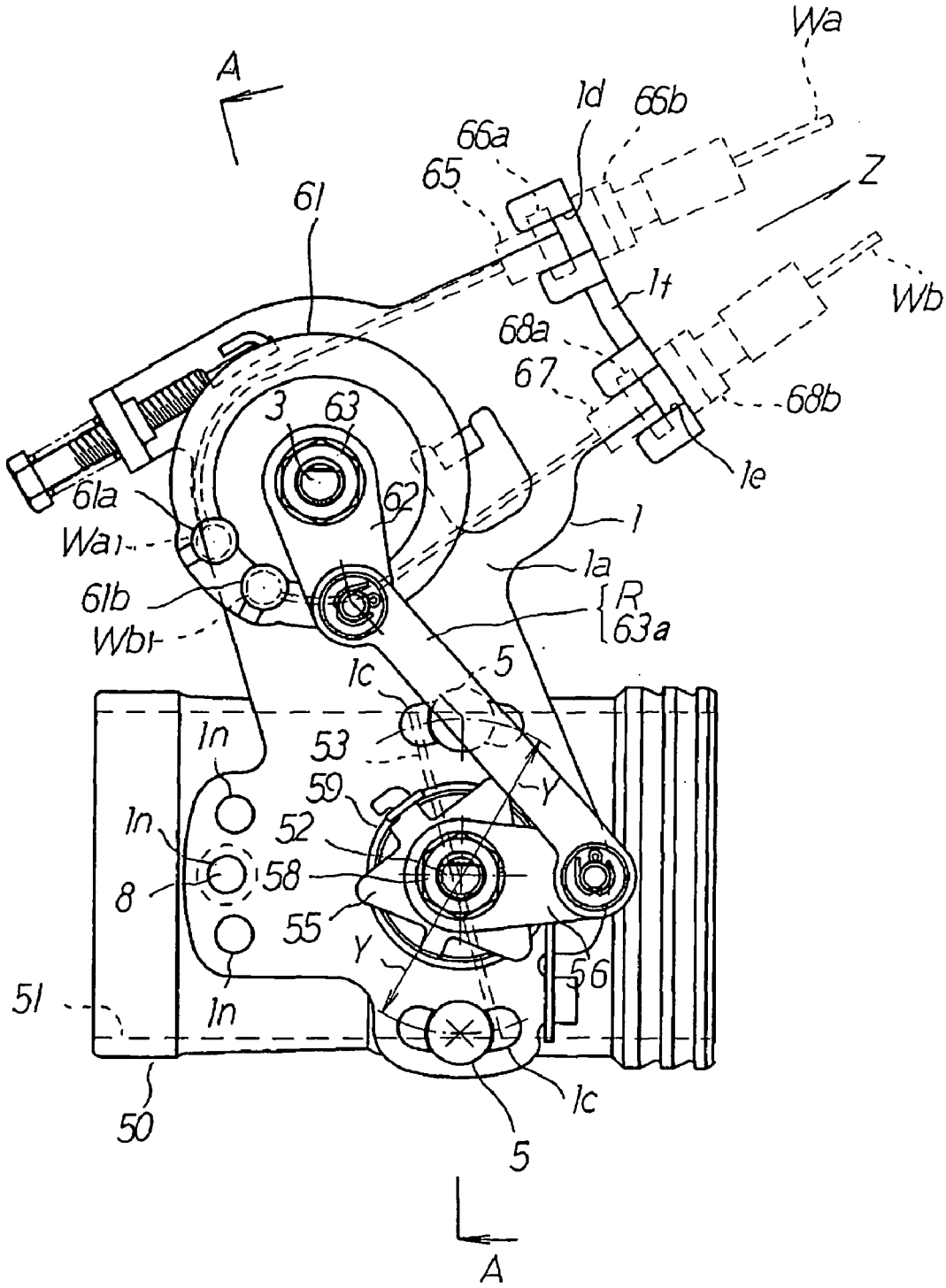
FIG. 1 is a side view illustrating a first example of a link type throttle valve control device in a throttle body of the present invention.

FIG. 1 is a side view of a link type throttle valve control device. FIG. 2 is a longitudinal sectional view taken along a line A—A in FIG. 1.

Figure 6:
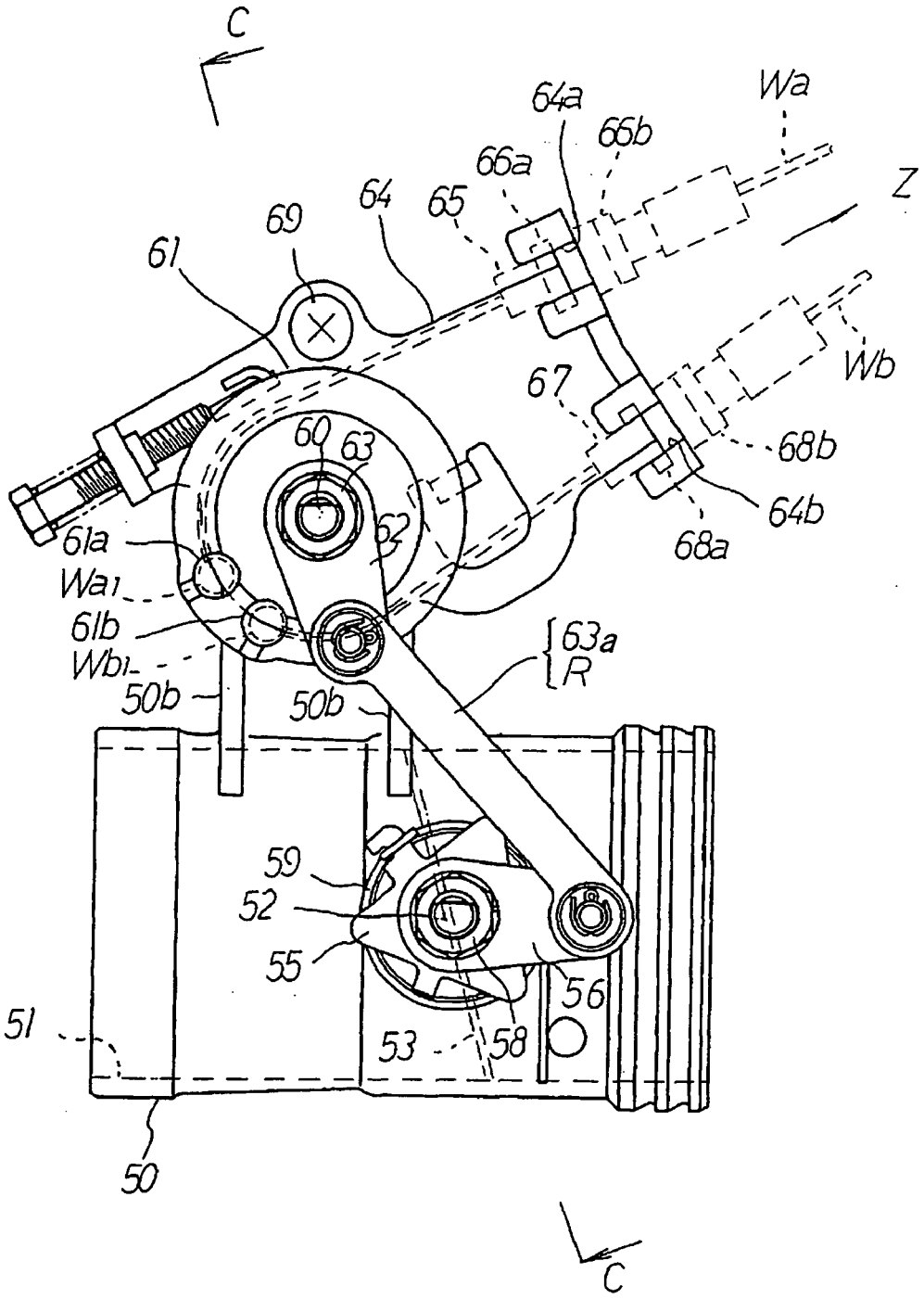
FIG. 6 is a side view illustrating a conventional link type throttle valve control device in a throttle body.
Figure 7:
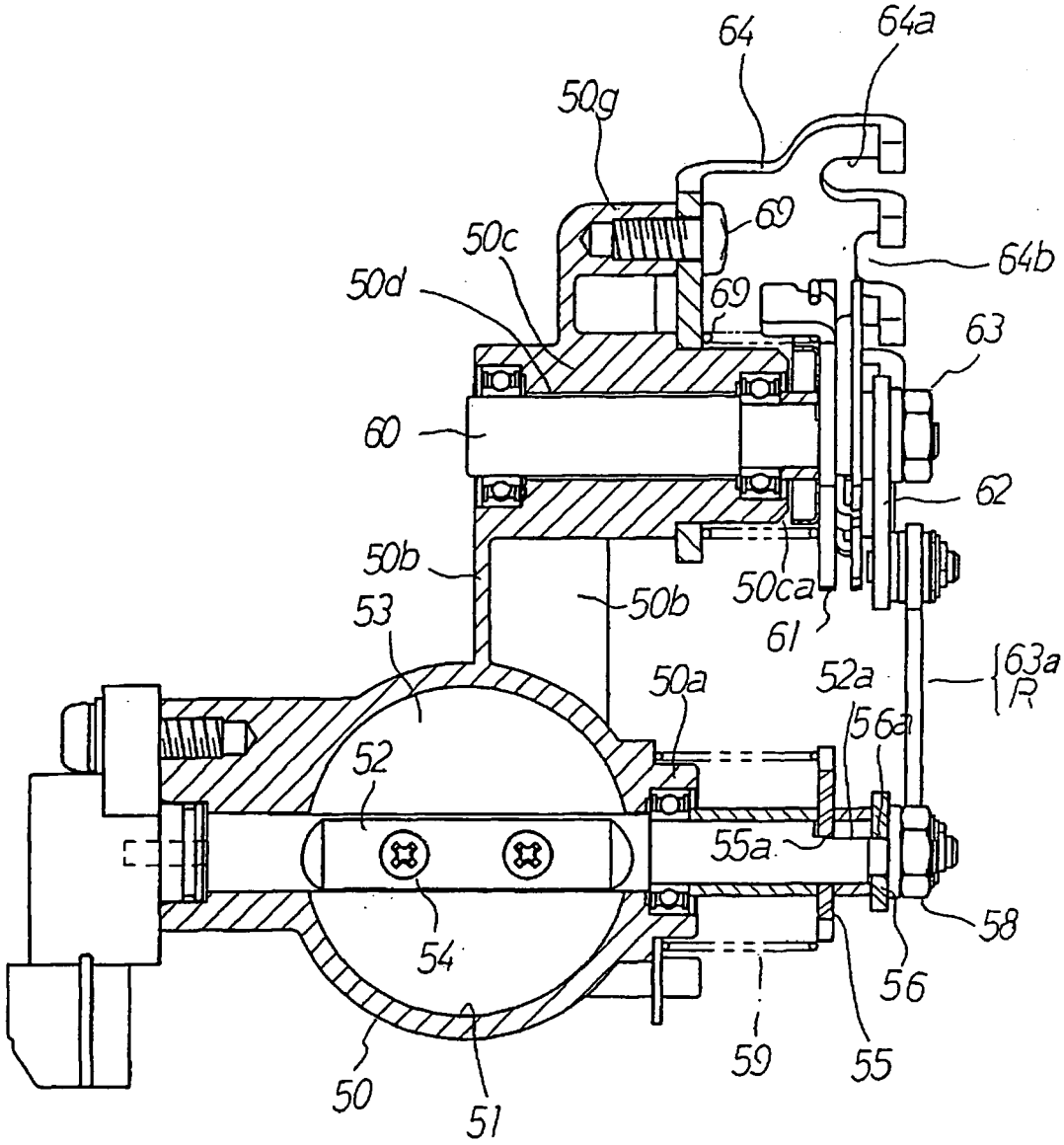
FIG. 7 is a longitudinal sectional view of main portions taken along a line C—C in FIG. 6.

In this case, same reference numerals and codes are used to parts of same structures as those of FIGS. 6 and 7, and descriptions are omitted.

Reference numeral 1 is a stay plate formed by a press molding of a metal plate, and has a rotation hole 1*b* provided at a flat bottom portion 1*a* thereof.

The rotation hole 1*b* is rotatably inserted and provided on an outer circumference surface of a right side bearing boss 50*a* of a throttle body 50 with a very small space (for example, 0.5 mm), and rotatably formed coaxially with respect to a longitudinal axial line X—X of a throttle valve shaft 52.

Further, the stay plate 1 has circular-arc grooves 1*c* provided in the radial direction coaxially with the rotation hole.

That is, the circular-arc grooves 1*c* are formed in a circular arc shape in the radial direction Y around the longitudinal axial line X—X of the throttle valve shaft 52. In this example, two circular-arc grooves 1*c* are provided symmetrically.

Furthermore, a throttle valve bearing boss 2 is provided at a position with a distance from the rotation hole in the bottom portion 1*a* of the stay plate 1. A throttle valve operation shaft 3 is rotatably provided at an operation bearing hole 2*a*, which is provided at the throttle valve bearing boss 2, through bearings 4*a*, 4*b*.

The throttle valve bearing boss is welded with, for example, the stay plate 1.

Further, the throttle valve operation shaft 3 is rotatably inserted into the operation bearing hole 2*a* of the throttle valve bearing boss 2, and a throttle valve operation dram 61 and a first link lever 62 are screwed and fixed at the throttle valve operation shaft 3 by a nut 63, where the throttle valve operation shaft 3 is projected toward the right side from the throttle valve bearing boss 2, and the throttle valve operation dram 61 is provided with an opening valve end inserting hole 61*a* and a closing valve end inserting hole 61*b*.

Figure 2:
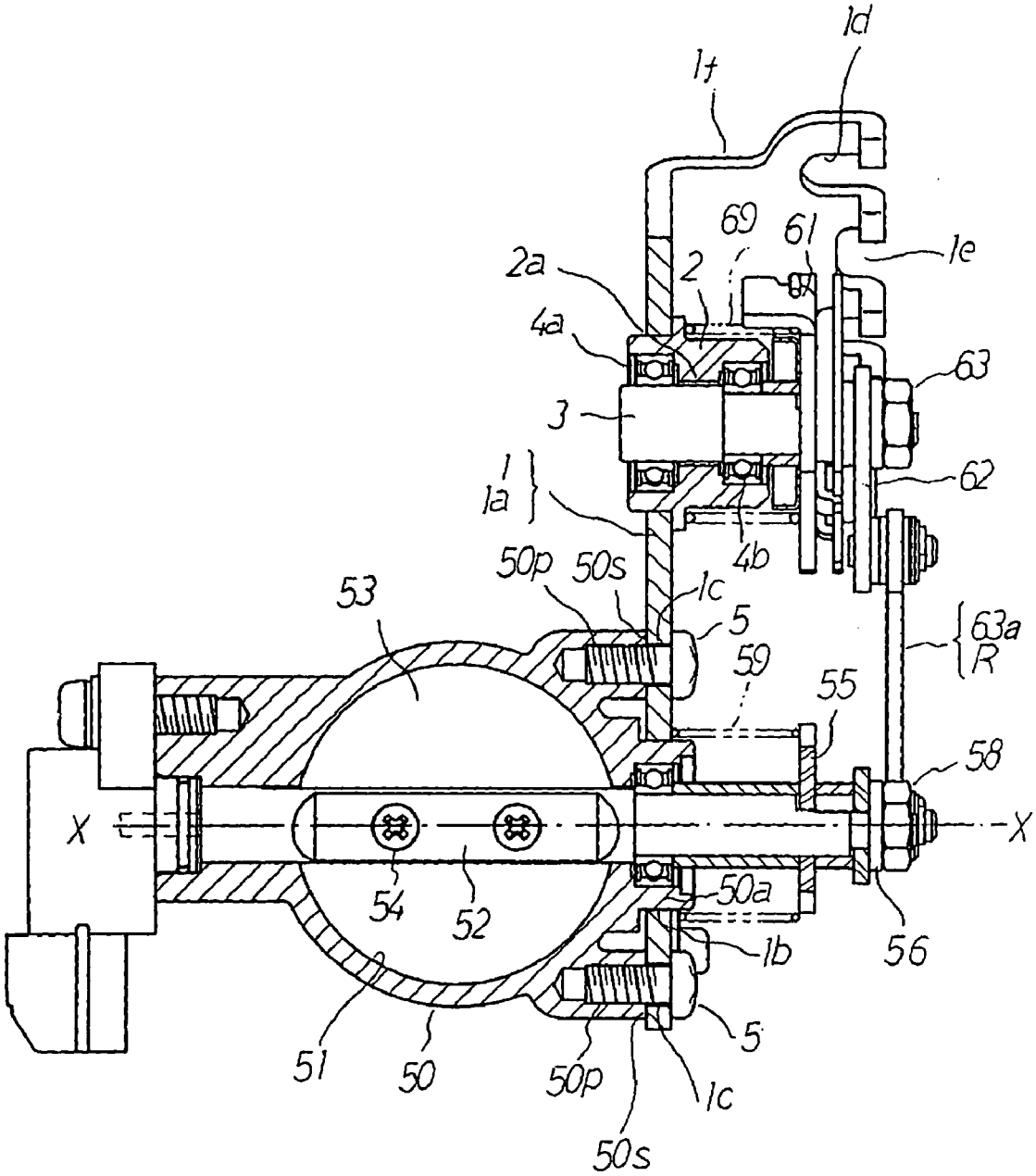
FIG. 2 is a longitudinal sectional view of main portions taken along a line A—A in FIG. 1.

Further, an outside end extending toward the right side in FIG. 1 of the bottom portion 1*a* of the stay plate 1 is bent in the right direction in FIG. 2 to form a bent portion 1*f*. A first cable guide inserting hole 1*d* and a second cable guide inserting hole 1*e* are formed at this bent portion 1*f* by cutting those out.

The first cable guide inserting hole 1*d* is formed at the position facing to the opening valve end inserting hole 61*a* of the throttle valve operation dram 61, and the second cable guide inserting hole 1*e* is formed at a position facing to the closing valve end inserting hole 61*b*.

Further, the rotation hole 1*b* of the stay plate 1 provided with the throttle valve operation shaft 3, the throttle valve operation dram 61 and the first link lever 62, is inserted and provided toward an outer circumference portion of the right side bearing boss 50*a* of the throttle body 50. While this state is kept, screws 5 are inserted into the circular-arc grooves 1*c* of the stay plate 1, and screwed into female screw holes 50*p* provided at the throttle body 50.

Accordingly, the bottom portion 1*a* of the stay plate 1 is screwed and fixed on a right side surface 50*s* of the throttle body 50. Such a screwing state of the stay plate 1 is illustrated in FIG. 1. This state is, for example, an intermediate rotation position of the circular-arc grooves 1*c*.

Then, a return lever 55 and a second link lever 56 are screwed and fixed at a right end of the throttle valve shaft 52 by a nut 58, where the throttle valve shaft 52 is projected in the right direction from the right end surface 50*s* of the right side bearing boss 50*a* of the throttle body 50. Further, the first link lever 62 and the second link lever 56 are linked and connected by a connection lever 63*a*.

Further, a first cable guide 65 is inserted into the first cable guide inserting hole 1*d* of the stay plate 1, and is screwed and fixed at the stay plate 1 by nuts 66*a*, 66*b*. Further, an opening valve wire end Wa1 of an opening valve wire Wa is inserted and locked in the opening valve end inserting hole 61*a* of the throttle valve operation dram 61.

On the other hand, a second cable guide 67 is inserted into the second cable guide inserting hole 1*e* of the stay plate 1, and screwed and fixed at the stay plate 1 by nuts 68*a*, 68*b*. Further, a closing valve wired end Wb1 of a closing valve wire Wb is inserted and locked in the closing valve end inserting hole 61*b* of the throttle valve operation dram 61.

Accordingly, when the opening valve wire Wa is pulled in the right direction in FIG. 1 like the conventional one, the throttle valve operation dram 61 is rotated in the clockwise direction in FIG. 1, and this rotation rotates the throttle valve shaft 52 in the counterclockwise direction through the first link lever 62, the connection lever 63 and the second link lever 56, which structure a link mechanism R. Thereby, the throttle valve 53 can be controlled to be opened corresponding to the pulling margin of the opening valve wire Wa.

On the other hand, when the closing valve wire Wb is pulled in the right direction in FIG. 1, the throttle valve operation dram 61 is rotated in the counterclockwise direction in FIG. 1, and this rotation rotates the throttle valve shaft 52 in the clockwise direction through the link mechanism R. Thereby, the throttle valve 53 can be controlled to be closed corresponding to the pulling margin of the closing valve wire Wb.

Further, pulling directions Z of the opening valve wire Wa and closing valve wire Wb are changed as follows.

A case of upwardly moving the pulling direction Z from a state of FIG. 1 will be described by using FIG. 3.

The screws 5 are loosened to thereby release screwing and fixing of the stay plate 1 and the throttle body 50. In this state, the rotation hole 1*b* of the stay 1 is rotated in the counterclockwise direction with respect to the right side bearing boss 50*a* of the throttle body 1. Then, the stay 1 is rotated around the longitudinal axial line X—X of the throttle valve shaft 52.

On the other hand, the circular-arc grooves 1*c* are also provided in the radial direction on the basis of the longitudinal axial line X—X of the throttle valve shaft 52. Thus, in the state in which the screws 5 are loosely screwed to the female screw holes 50*p*, the circular-arc grooves 1*c* can support the rotation of the stay plate in the counterclockwise direction.

Further, while the state in which the stay plate 1 is rotated in the desired counterclockwise direction is kept, the screws 5 are re-screwed to the female screw hole 50*p* through the circular-arc grooves 1*c*. Thereby, the throttle body 56 can be fixed in the state in which the stay plate 1 is moved in the counterclockwise direction as compared with the original position.

Figure 3:
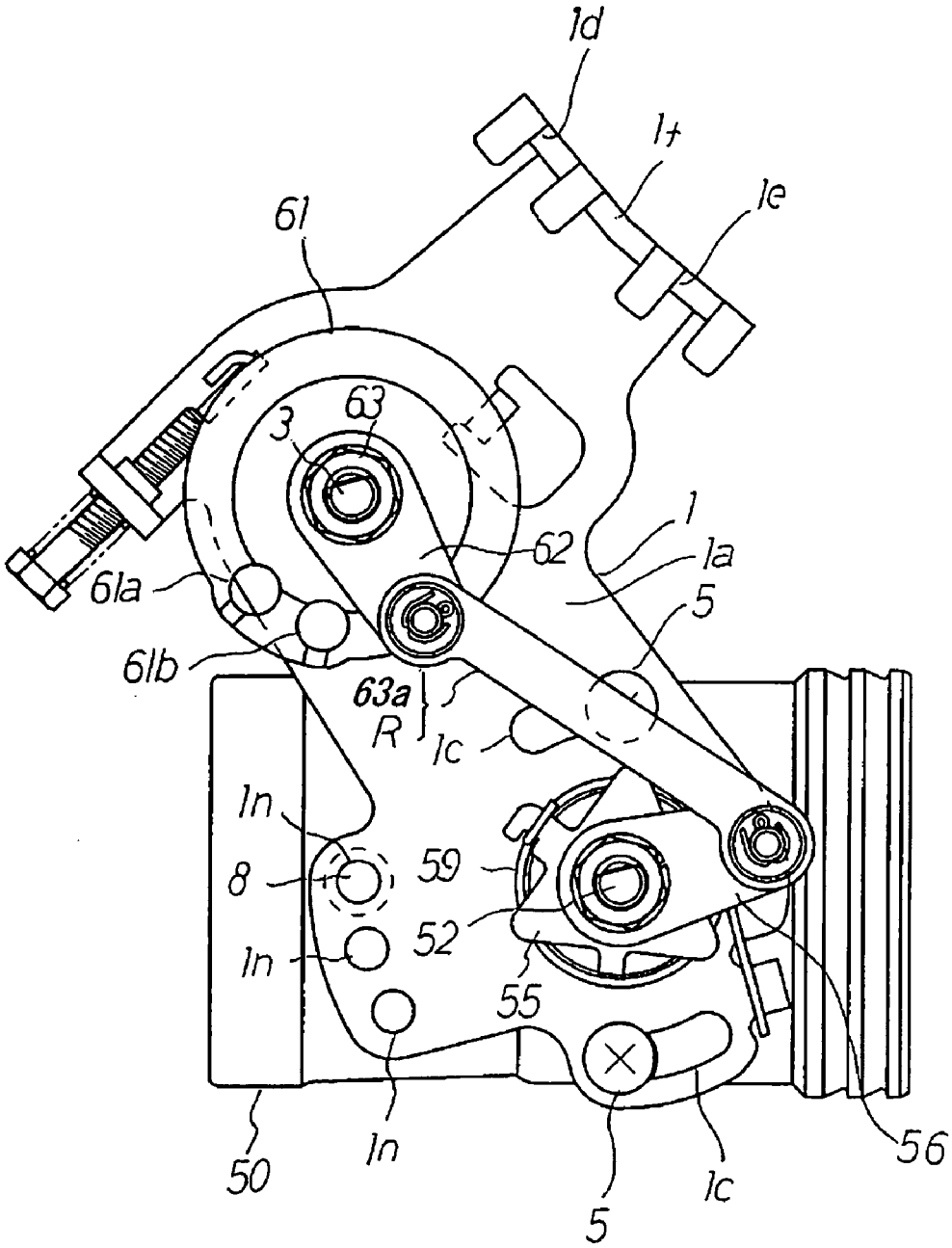
FIG. 3 is a side view illustrating a link type throttle valve control device illustrating a state in which the link type throttle valve control device being in a stat of FIG. 1 is rotated in the counterclockwise direction to thereby change a pulling direction Z.

A state of FIG. 3 is that the stay plate 1 is moved in the most counterclockwise direction. However, the stay plate can be rotated in the clockwise direction from the original position, and a rotation angle range can be freely selected by selecting a groove length of the circular-arc grooves 1*c* in the rotational direction.

According to the link type throttle valve device of the present invention, structure is made as follows: The throttle valve operation shaft 3 provided with the throttle valve operation dram 61 and the first link lever 62 is rotatably provided at the operation bearing hole 2*a* of the stay plate 1, where the throttle valve operation dram 61 is provided with the opening valve hole 61*a* and closing valve end inserting hole 61*b*.

The first cable guide inserting hole 1*d* facing to the opening valve end inserting hole 61*a* and the second cable guide inserting hole facing to the closing valve end inserting hole 61*b* are provided at the stay plate 1.

Further, the stay plate 1 is rotatably provided coaxially with the longitudinal axial line X—X of the throttle valve shaft 52.

Furthermore, the first link lever 62 and the second link lever 56 are linked and connected by the connection lever 63*a*, where the second link lever 56 are fixed and provided at the end portion of the throttle valve shaft 52.

Thereby, when the stay plate 1 is rotated on the basis of the longitudinal axial line X—X of the throttle valve shaft 52 to thereby change the pulling direction Z of the wires, the relative position relationship between the first cable guide 65 and the opening valve end inserting hole 61*a* of the throttle valve operation dram 61, and the relative position relationship between the second cable guide 67 and the closing valve end inserting hole 61*b* of the throttle valve operation dram 61, are not changed at all and thus, the throttle valve operation shaft 3 and the throttle valve shaft 52 can be connected and held through the link mechanism R.

Therefore, the stay plate 1 is rotated to the desired position on the basis of the longitudinal axial line X—X of the throttle valve shaft 52, and while this state is kept, the stay plate 1 is screwed and fixed at the throttle body 50. Then, the pulling direction Z of the wires can be suitably selected.

Further, when the position of the stay plate is selected, it is not necessary at all to change the stay plate 1, the throttle valve operation dram 61, the first link lever 62, the throttle body 50, the second link lever 56 and the connection lever 63*a*. Thus, the manufacturing cost and the managing process of parts are not increased.

Further, since the throttle valve operation shaft 3 is not provided in the throttle body 50, it is possible especially to decrease the throttle body in size and thereby, the mold structure of the throttle body 50 becomes easy. Thus, the mold cost can be decreased, and the moldability of the throttle body can be enhanced.

In addition, reference numeral 8 is a positioning projection portion for preventing the rotation of the stay plate 1 when the stay plate 1 is screwed to the throttle body 50 by the screws 5 in the state in which the stay plate 1 is rotated to the desired position. A plurality of positioning holes in is provided on the stay plate 1. Such a plurality of the positioning holes 1*n* provided along a rotating direction of the stay plate Then, a second example will be described with FIGS. 4 and 5.

Figure 4:
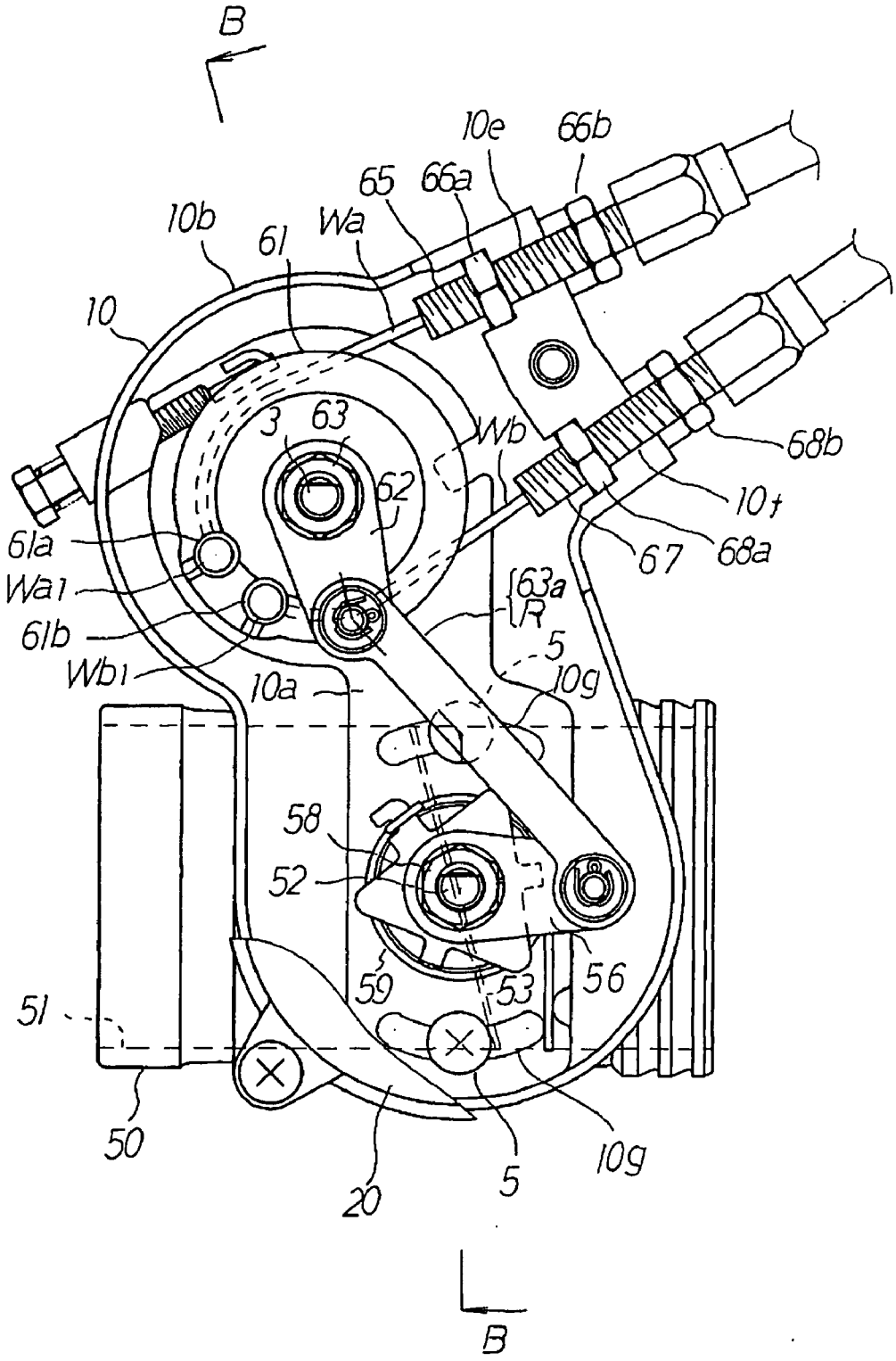
FIG. 4 is a side view illustrating a second example of a link type throttle valve control device in a throttle body of the present invention.

FIG. 4 is a side view of a link type throttle valve control device in a state in which a second case body is removed.

Figure 5:
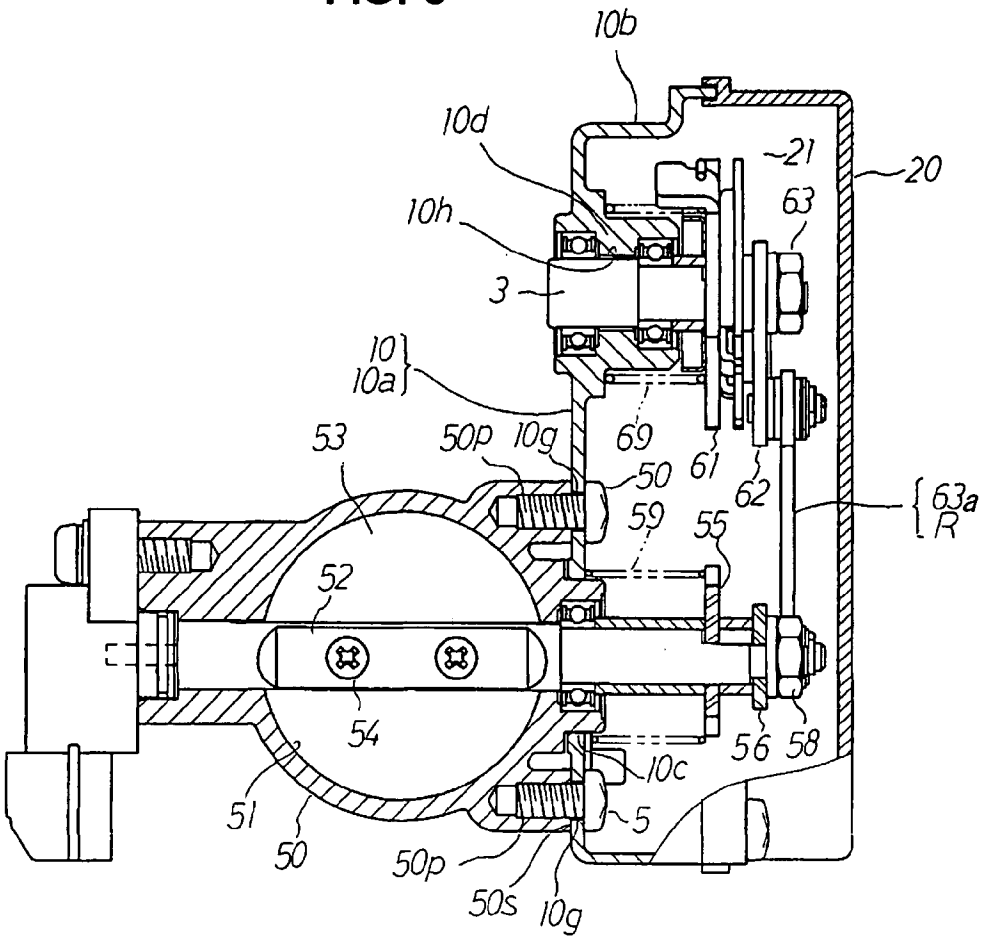
FIG. 5 is a longitudinal sectional view of main portions taken along a line B—B in FIG. 4.

FIG. 5 is a longitudinal sectional view taken along a line B—B in FIG. 4 in a state in which the second case body is mounted.

In this case, same reference numerals and codes are used to parts of same structure as those of FIG. 1 and descriptions are omitted.

Reference numeral 10 is a bottomed cup shaped first case body, which comprises a bottom portion 10*a* and a wall portion 10*b* bent in the right direction in FIG. 5 from the outside of the bottom portion 10*a*. A rotation hole 10*c* being same as the rotation hole 1*b* of the first example is provided at the bottom portion 10*a*, and a throttle valve bearing boss 10*d* is integrally formed at a position with a distance from the rotation hole 10*c*. Further, a circular-arc grooves 10*g* being same as the circular-arc grooves 1*c* of the first example are provided at the bottom portion 10*a*.

Further, a first cable guide inserting hole 10*e* and a second cable guide inserting hole 10*f* are provided at the wall portion 10*b*. The first case body 10 is manufactured by the injection molding.

Further, the throttle valve operation shaft 3 is rotatably provided at an operation bearing hole 10*h* provided at the throttle valve bearing boss 10*d*, and the throttle valve operation dram 61 and the first link lever 62 are screwed to an end portion in the right direction of the throttle valve operation shaft 3 by the nut 63, where the throttle valve operation dram 61 is provided with an opening valve end inserting hole 61*a* and a closing valve end inserting hole 61*b*.

The first cable guide inserting hole is formed facing to the opening valve end inserting hole 61*a*, and the second cable guide inserting hole 10*f* is formed facing to the closing valve end inserting hole 61*b*.

Further, the rotation hole 10*c* of the first case body 10 provide with the throttle valve operation shaft 3, the throttle valve operation dram 61 and the first link lever 62 is inserted and provided in an outer circumference of the right side bearing boss 50*a* of the throttle body 50. While this state is kept, the screws 5 are inserted into the circular-arc grooves 10*g*, and the screws 5 are screwed into the female screw holes 50*p* of the throttle body 50. Thereby, the bottom portion 10*a* of the first case body 10 is screwed and fixed on a right side surface 50*s* of the throttle body 50.

Further, the return lever 55 and the second link lever 56 are screwed to the right end of the throttle valve shaft 52 by the nut 58, and the first link lever 62 and the second link lever 56 are linked and connected by the connection lever 63*a*.

Further, the first cable guide 65 is provided at the first cable guide inserting hole 10*e*, and screwed to the first case body 10 by the nuts 66*a*, 66*b*.

Further, the opening valve wire end Wa1 of the opening valve wire Wa is inserted and locked in the opening valve end inserting hole 61*a*, where the opening valve wire Wa is inserted and provided in the first cable guide 65.

Further, the second cable guide 67 is provided at the second cable guide inserting hole 10*f*, and screwed to the first case body 10 by the nuts 68*a*, 68*b*.

Further, the closing valve wire end Wb1 of the closing valve wire Wb is inserted and locked in the closing valve end inserting hole 61*b*, where the closing valve wire Wb is inserted and provided in the second cable guide 67.

Then, a bottomed cup shaped second case body 20 is contacted and provided at an opening end of the wall portion

10*b* of the first case body 10, and fixed by screwing, to thereby close the opening of the first case body 10.

Accordingly, the throttle operation chamber 21 is formed in the sealing state with the first case body 10 and the second case body 20. The throttle valve operation dram 61 including the second return spring 69, the link mechanism R, and the return lever 55 including the first return spring 59 are housed in the throttle chamber 21, where the link mechanism R comprises the first return lever 62, the connection lever 63*a* and the second link lever 56.

According to the second example, the first case body 10 is rotated on the basis of the longitudinal axial line X—X of the throttle valve shaft 52, by removing the second case body 20 from the first case body 10 and loosening the screws 5 provided at the circular-arc grooves 10*g* in the state in which the first case body 10 is opened. Thereby, pulling direction Z of the wires can be freely changed.

Such an action and effect are same as those of the first example. However, according to the second example, the following especial effects can be obtained in addition to the above-described effects.

The throttle operation chamber 21 is formed in the sealing state on the right end surface 50*s* of the throttle body 50 with the first case body 10 and the second case body 20.

All throttle operating systems are provided in the throttle operation chamber 21.

More particularly, the first return spring 59, the return lever 55, the link mechanism R, the second return spring 69 and the throttle valve operation dram 61 are provided in the throttle operation chamber 21, where the link mechanism R comprises the first return lever 62, the connection lever 63*a* and the second link lever 56.

Accordingly, when the motorcycle is used on an off-road especially, it can be completely prevented to collide with an obstacle, adhere mud, water, dust or the like, and the motorcycle can be stably used for along time of period, and the frequency of a maintenance can be decreased.

Further, especially in the motorcycle, the throttle body is directly exposed to the atmosphere. However, the throttle operating systems are covered with the first case body 10 and the second case body 20, so that the appearance of the motorcycle can be improved, and freedom of selecting a design can be also improved.

Further, in the above-described examples, the circular-arc grooves 1*c*, 10*g* are provided at the bottom portion 1*a*, 10*a* of the stay plate 1 or the first case body 10 on the basis of the longitudinal axial line X—X of the throttle valve shaft 52. Thus, the stay plate 1 or the first case body 10 can be accurately rotated to the desired position with a very small rotation angle, and the pulling direction Z can be set by stepless.

Further, the two circular-arc grooves are provided symmetrically on the both sides of the longitudinal axial line X—X of the throttle valve shaft 52. Thus, the stay plate 1 or the first case body 10 can be fixed at the throttle body 50 more strongly.

In addition, when screw guide holes to be inserted with the screws 5 are provided with equal spaces in the radial direction instead of the circular-arc grooves, the stay plate 1 or the first case body 10 can be fixed by rotating those.

Further, these examples relate to the throttle body used in the fuel injection device, but those can be used to a link type throttle valve control device of a vaporizer.

What is claimed is:

1. A link type throttle valve control device in a throttle body, the device comprising;

a throttle valve shaft which crosses an intake passage provided in the throttle body, is mounted with a throttle valve for opening/closing the intake passage, and is supported rotatably to the throttle body;

a throttle valve operation shaft, which is supported rotatably to the throttle body, and is mounted with a throttle body operation dram provided with an opening valve end inserting hole and a closing valve end inserting hole at an end portion thereof;

a stay plate, which is provided with a first cable guide inserting hole and a second cable guide inserting hole, and mounted at the throttle body; and a link mechanism comprising a first link lever mounted at an end portion of the throttle valve operation shaft, a second link lever mounted at an end portion of the throttle valve shaft, and a connection lever for connecting the first link lever and the second link lever, wherein rotation of the throttle valve operation dram operated by an operator is transmitted to the throttle valve shaft through the link mechanism and thereby, the intake passage is opened/closed by throttle valve, wherein a throttle valve operation shaft is rotatably provided at a stay plate, where the throttle valve operation shaft is mounted with a throttle valve operation dram and a first link lever, and an opening valve end inserting hole and a closing valve end inserting hole are provided in the throttle valve operation dram, wherein a first cable guide inserting hole and a second cable guide inserting hole are formed at the stay plate, wherein the stay plate is rotatably provided coaxially with a longitudinal axial line of a throttle valve shaft, and the first link lever and the second link lever mounted at the throttle valve shaft are linked by a connection lever, and wherein the stay plate is rotated to be provided at a desired position with respect to the throttle valve shaft, and the stay plate is screwed and fixed at a throttle body by screws to keep this state.

2. The link type throttle valve control device in the throttle body as claimed in claim 1, wherein circular-arc grooves are provided in the radial direction at the bottom portion of the stay plate or the first case body on the basis of the longitudinal axial line of the throttle valve shaft, and wherein the stay plate or the first case body are screwed and fixed at the throttle body by the screws through the circular-arc grooves.

3. The link type throttle valve control device in a throttle body, the device comprising;

the throttle valve shaft which crosses an intake passage provided at the throttle body, is mounted with a throttle valve for opening/closing the intake passage, and is supported rotatably to the throttle body;

the throttle valve operation shaft which is supported rotatably to the throttle body, and mounted with a throttle body operation dram provided with an opening valve end inserting hole and a closing valve end inserting hole at an end portion thereof;

the stay plate which is provided with a first cable guide inserting hole and a second cable guide inserting hole, and is mounted at the throttle body; and the link mechanism comprising a first link lever mounted at an end portion of the throttle valve operation shaft, a second link lever mounted at an end portion of the throttle valve shaft, and a connection lever for connecting the first link lever and the second link lever, wherein rotation of the throttle valve operation dram operated by an operator is transmitted to the throttle valve shaft through the link mechanism, and thereby the intake passage is opened/closed by throttle valve, wherein a throttle operation chamber is formed in a sealing state with a bottomed cup shaped first case body and a second case body is for closing an opening of the first case body, where the first case body comprises a bottom portion contacted with a throttle body, and a wall portion extending in the one side direction from the bottom portion, wherein the bottom portion of the first case body is rotatably provided coaxially with a longitudinal axial line of a throttle valve shaft, wherein the throttle valve operation shaft is supported rotatably to the first case body, where the throttle valve operation shaft is mounted with a throttle valve operation dram and a first link lever, and an opening valve end inserting hole and a closing valve end inserting hole are provided in the throttle valve operation dram, wherein the wall portion of the first case body has a first cable guide inserting hole and a second cable guide inserting hole, wherein the throttle valve operation dram, the first link lever, the second link lever and the connection lever, which is for connecting the first link lever and the second link lever, are provided in the throttle operation chamber, and wherein the first case body is rotated to be provided at a desired position with respect to the throttle valve shaft, and the bottom portion of the first case body is screwed and fixed at a throttle body by screws to keep this state.

4. The link type throttle valve control device in the throttle body as claimed in claim 3, wherein circular-arc grooves are provided in the radial direction at the bottom portion of the stay plate or the first case body on the basis of the longitudinal axial line of the throttle valve shaft, and wherein the stay plate or the first case body are screwed and fixed at the throttle body by the screws through the circular-arc grooves.

* * * * *